US007617751B2

(12) United States Patent
James et al.

(10) Patent No.: US 7,617,751 B2
(45) Date of Patent: Nov. 17, 2009

(54) QUILTED FABRIC PANEL CUTTER

(75) Inventors: Michael A. James, Davie, FL (US); David Brian Scott, Carthage, MO (US); Terrance L. Myers, Coral Springs, FL (US)

(73) Assignee: L&P Property Management Company, South Gate, CA (US)

( * ) Notice: Subject to any disclaimer, the term of this patent is extended or adjusted under 35 U.S.C. 154(b) by 430 days.

(21) Appl. No.: 11/339,602

(22) Filed: Jan. 25, 2006

(65) Prior Publication Data

US 2006/0179989 A1 Aug. 17, 2006

Related U.S. Application Data

(63) Continuation-in-part of application No. 10/963,300, filed on Oct. 12, 2004, now abandoned.

(60) Provisional application No. 60/555,460, filed on Mar. 23, 2004.

(51) Int. Cl.
*B26D 5/00* (2006.01)
*B26D 5/34* (2006.01)
*B26D 11/00* (2006.01)

(52) U.S. Cl. ..... 83/33; 83/39; 83/302; 83/286; 83/289; 83/371

(58) Field of Classification Search ..... 83/301–302, 83/286–293, 425.4, 371, 368, 508, 475.08, 83/33, 34, 39; 112/475.08
See application file for complete search history.

(56) References Cited

U.S. PATENT DOCUMENTS 1,090,388 A 3/1914 Foote
3,407,690 A 10/1968 Stanley
3,628,253 A 12/1971 Shepard
3,896,749 A 7/1975 Brauns et al
3,919,561 A 11/1975 Coberley
3,958,477 A 5/1976 Carlson
4,161,974 A 7/1979 Patterson
4,583,181 A 4/1986 Gerber et al.
4,676,130 A 6/1987 Nutt
4,683,658 A 8/1987 Stumpf
4,701,018 A 10/1987 Loucks
4,715,238 A 12/1987 Bernardi
4,781,317 A * 11/1988 Ditto ..... 226/27

(Continued)

FOREIGN PATENT DOCUMENTS

DE 3801820 11/1988

(Continued)

*Primary Examiner*—Boyer D. Ashley
*Assistant Examiner*—Laura M. Lee
(74) *Attorney, Agent, or Firm*—Wood, Herron & Evans, L.L.P.

(57) ABSTRACT

An apparatus for cutting a quilted material web having a quilted patterns thereon into panels having a desired length and width with respective quilted patterns centered therein. A first detector detects a center of a quilted pattern on the quilted material web; and in response thereto, a cutting apparatus cuts the quilted material web to form edges of a panel equidistant from the quilted pattern center. The cutting apparatus includes a pair of trim blades that cut opposite side edges of the panel equidistant from the quilted pattern center and a cross cutting apparatus that cuts end edges of the panel equidistant from the quilted pattern center.

6 Claims, 6 Drawing Sheets

U.S. PATENT DOCUMENTS

| | | | | |
|---|---|---|---|---|
| 4,885,967 | A | 12/1989 | Bell et al. | |
| 4,907,323 | A | 3/1990 | Smith et al. | |
| 4,945,252 | A | 7/1990 | Lerner et al. | |
| 4,955,265 | A | 9/1990 | Nakagawa et al. | |
| 5,045,135 | A | 9/1991 | Meissner et al. | |
| 5,132,510 | A | 7/1992 | Klingel et al. | |
| 5,154,130 | A | 10/1992 | Gribetz et al. | |
| 5,235,515 | A | 8/1993 | Ungpiyakul et al. | |
| 5,259,495 | A | 11/1993 | Douglas | |
| 5,322,001 | A | 6/1994 | Boda | |
| 5,446,635 | A | 8/1995 | Jehn | |
| 5,488,781 | A | 2/1996 | Van Der Horst | |
| 5,544,599 | A | 8/1996 | Frazer et al. | |
| 5,675,899 | A | 10/1997 | Webb | |
| 5,766,389 | A | 6/1998 | Brandon et al. | |
| 5,794,526 | A * | 8/1998 | Raney | 100/39 |
| 5,960,554 | A | 10/1999 | Kamykowski | |
| 6,003,217 | A | 12/1999 | Graves et al. | |
| 6,050,168 | A | 4/2000 | Kuchta et al. | |
| 6,073,621 | A | 6/2000 | Cetrangolo | |
| 6,190,066 | B1 * | 2/2001 | Ishigouoka et al. | 400/120.01 |
| 6,435,117 | B2 | 8/2002 | Codos et al. | |
| 6,644,156 | B2 | 11/2003 | Villacis | |
| 6,736,078 | B2 | 5/2004 | Kaetterhenry et al. | |
| 6,796,254 | B2 | 9/2004 | Bondanza et al. | |
| 6,848,846 | B2 | 2/2005 | Codos et al. | |
| 2001/0045147 | A1 | 11/2001 | Schultes | |
| 2002/0166467 | A1 * | 11/2002 | Codos et al. | 101/35 |

FOREIGN PATENT DOCUMENTS

| | | |
|---|---|---|
| WO | WO0107699 | 2/2001 |
| WO | WO2005102625 | 11/2005 |

* cited by examiner

QUILTED FABRIC PANEL CUTTER

This application is a continuation-in-part of U.S. application Ser. No. 10/963,300, filed on Oct. 12, 2004, now abandoned, which claims the benefit of U.S. Provisional Application Ser. No. 60/555,460, filed on Mar. 23, 2004, and which applications are hereby expressly incorporated by reference herein.

FIELD OF THE INVENTION

This invention relates generally to cutting flat stock and, more particularly, to cutting quilted fabric goods.

BACKGROUND OF THE INVENTION

Quilting is a sewing process by which layers of textile material and other fabric are joined to produce compressible panels that are both decorative and functional. Stitch patterns are used to decorate the panels with sewn designs while the stitches themselves join the various layers of material that make up the quilts. Large scale quilting processes usually use high-speed multi-needle quilting machines to form a series of panels along webs of the multiple-layered materials. These large scale quilting processes typically use chain-stitch sewing heads which produce resilient stitch chains that can be supplied by large spools of thread.

After the pattern has been stitched in a panel, the panel must be cut to length and trimmed to a width such that the stitched pattern is centered on the cut panel. If a panel is automatically cut from a quilted material web without locating the quilted pattern, the quilted pattern may be shifted to one side of the panel or, in some circumstances, may be partially cut off when the panel was cut from the web. Thus, the panel must be cut from the web using manual or semiautomatic processes in which an operator is used to align cutting devices so that the quilted pattern is approximately centered in the panel. Further, proper centering of the pattern on the panel facilitates a more automated and less labor intensive panel assembly or sewing process. Therefore, there is a need to provide a panel cutter of a relatively simple design that accurately and quickly automatically centers the pattern on the panel in the cutting process.

SUMMARY OF THE INVENTION

The present invention provides a panel cutter and process that quickly positions cutters with respect to a quilted pattern in a panel. Further, the panel cutter and process of the present invention automatically cuts the panel to the proper length and width with the quilted pattern centered in the panel. In addition, the panel cutter of the present invention uses known, commercially available components and cutting devices and provides a relatively low cost solution to a difficult problem in the quilting industry. Thus, the panel cutter of the present invention is especially useful in cutting panels with quilted patterns from a quilted material web.

In accordance with the principles of the present invention and in accordance with the described embodiments, the present invention provides an apparatus for cutting a quilted material web having a quilted patterns thereon into panels having a desired length and width with respective quilted patterns centered therein. A first detector detects a center of a quilted pattern on the quilted material web; and in response thereto, a cutting apparatus cuts the quilted material web to form edges of a panel equidistant from the center of the quilted pattern.

In one aspect of the invention, the cutting apparatus is a trimming apparatus movable to a position displaced from the center of the quilted pattern a first distance in a transverse direction substantially perpendicular to a length of the quilted material web. The first distance being substantially equal to one-half the width of the panel, and the trimming apparatus being operable to cut the quilted material web to form a first side edge of the panel in a longitudinal direction in response to the first detector detecting the center of the quilted pattern.

In another aspect of the invention, the cutting apparatus is a pair of trim blades, wherein each of the trim blades is movable on an opposite side of the center of the quilted pattern. The pair of trim blades is operable to cut the quilted material web to form opposite side edges of the panel extending in the longitudinal direction equidistant from the center of the quilted pattern.

In a further aspect of the invention, the cutting apparatus includes a cross cutting apparatus movable in the transverse direction for cutting the quilted web material to form end edges of the panel extending in the transverse direction. A second detector is movable to a position displaced from the cross cutting apparatus by a second distance in the longitudinal direction, wherein the second distance is equal to the length of the panel. The second detector detects an end edge of the quilted material web, and the cross cutting apparatus is operable to cut the quilted material web and form end edges of the panel equidistant from the center of the quilted pattern.

These and other objects and advantages of the present invention will become more readily apparent during the following detailed description taken in conjunction with the drawings herein.

DETAILED DESCRIPTION OF THE INVENTION

Figure 1:
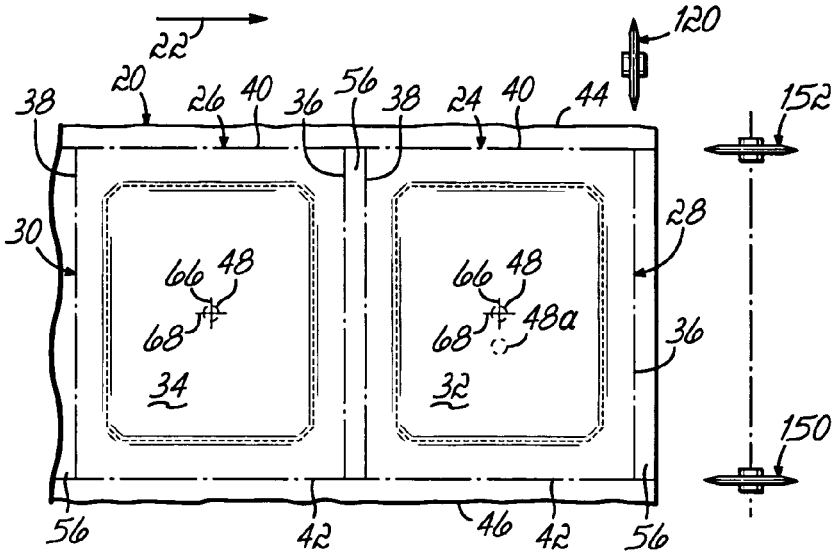
FIG. 1 is a schematic top view of a web of quilted material containing quilted panels to be cut therefrom.

Referring to FIG. 1, a web of quilted material 20 is conveyed along an output portion of a quilting machine (not shown) in a direction indicated by the flow arrow 22. Such quilting machines are of the type shown and described in U.S. Pat. No. 5,154,130 and U.S. Pat. No. 7,073,453, filed Mar. 19, 2004, which patents are hereby incorporated in their entirety by reference herein. The quilted material 20 is to be cut to form quilted panels 24, 26 with respective perimeters 28, 30 within which quilted patterns 32, 34 are located. Thus, to cut the panel 24 to a desired length, the quilted material web 20 must be cut along cut lines 36, 38. Further, to cut the panel 24 to a desired width, the quilted material web 20 is cut along trim lines 40, 42, thereby removing selvage pieces 44, 46.

As will be appreciated, due to the nature of the quilting process, the positions of successive quilted patterns 32, 34 often vary slightly, which substantially complicates the panel cutting process. For example, if the panels 24, 26 are cut to length after moving the quilted material web through an incremental feed equal to a panel length, the quilted patterns in some panels will not be centered. Panels with noncentered quilted patterns are more difficult to properly assemble and/or sew together with other panels; and if the quilted pattern is so far off-center that it can't be used, the panel has to be scrapped.

Thus, to facilitate an automatic, fast and efficient cutting of the panels 24, 26, a center or reference mark 48 is used and accurately centered with respect to the quilting patterns 32, 34 in the respective panels 24, 26. The center mark 48 can be automatically applied to the web 20 as part of the quilting process using a variety of mediums and processes, for example, a stick-on element, painting, detectable stitching, etc. Further, the center mark 48 can be of any useful shape, for example, a circle, a dot, crosshairs, etc. Alternatively, the center mark 48 can be printed on the web 20 using apparatus and methods shown and described in U.S. Pat. Nos. 6,435,117; 6,263,816; 6,158,366; 6,012,403 and 5,873,315, all of which are hereby incorporated in their entireties by reference herein. The center mark is often located on a backside of the panel, that is, the side opposite a side presenting the quilted pattern to a user.

Figure 2:
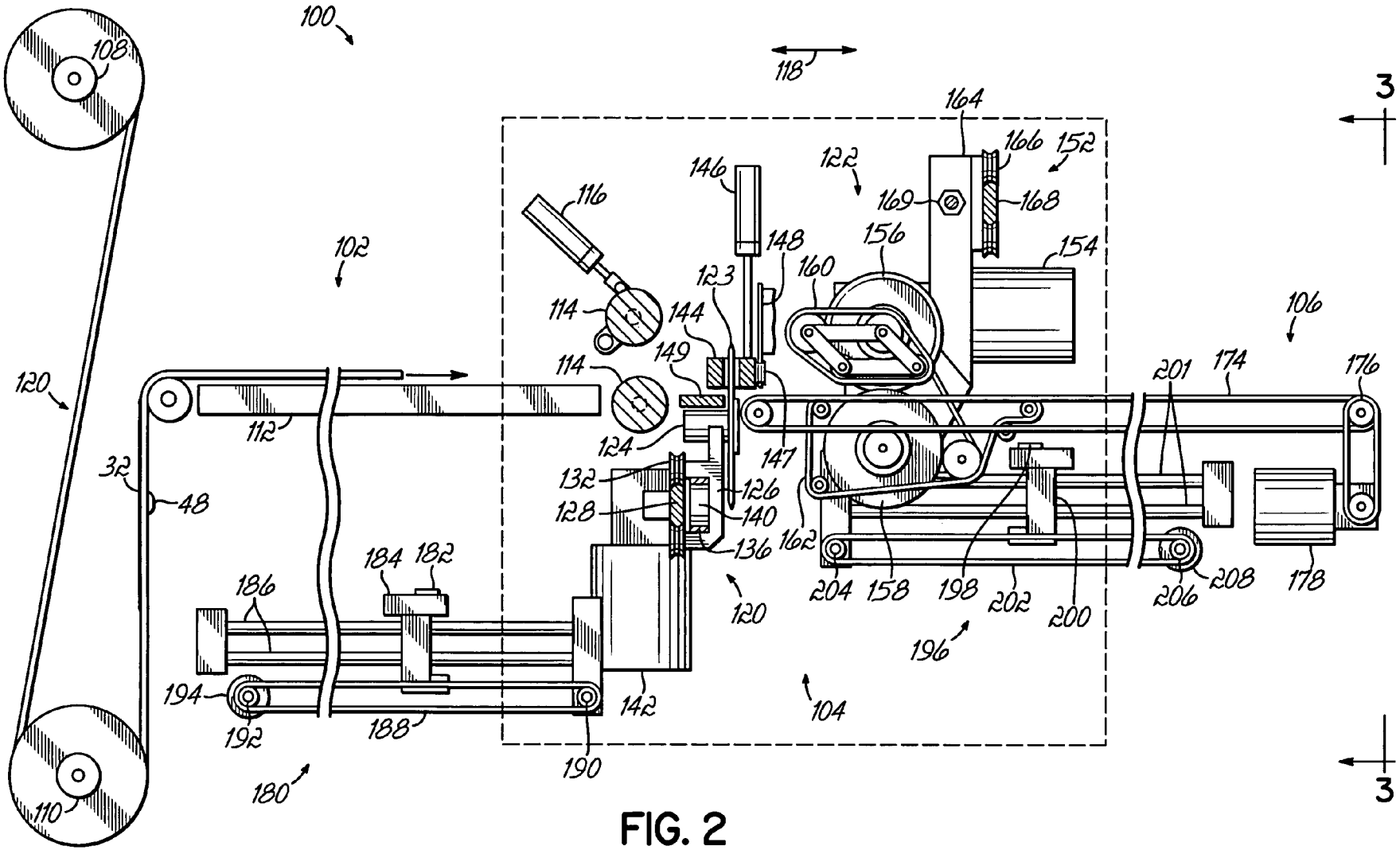
FIG. 2 is a schematic side view of one embodiment of a panel cutting machine that may be used to cut a panel from a quilted material web in accordance with the principles of the present invention.

Referring to FIG. 2, a panel cutter 100 has an upstream portion 102, a cutting portion 104 and a downstream portion 106. As used herein, "upstream" refers to a position, motion or direction to the left of a cross cut blade 123; and "downstream" refers to a position, motion or direction to the right of the cross cut blade 123. A quilted material web 20 is fed over rollers 108,110 across an upstream table 112 and through a pair of transversely extending, opposed pinch rollers 114. The pinch rollers are engaged and disengaged by means of actuators 116, for example, pneumatic cylinders. After the pinch rollers 114 are engaged with the quilted material web 20 pinched there between, actuator 117 (FIG. 3), for example, an electric motor, is turned On to feed the quilted material web between the pinch rollers 114 in a longitudinal direction 118 generally parallel to a length of the web.

The cutting portion 104 (FIG. 2) includes a cross cutting apparatus 120 and a trimming apparatus 122. The cross cutting apparatus 120 has a cutting blade 123 operatively connected to a motor 124 that is mounted on a carriage 126. A linear guide 128 extends in the transverse direction 130 (FIG. 3), that is, perpendicular to the longitudinal direction 118. The carriage 126 has a plurality of rollers 132 that ride on opposed longitudinal edges of the guide rail 128. The ends of a drive belt 136 are connected to the carriage 126 and are looped over an idler pulley 138 and a drive pulley 140 that is rotated by a motor 142. Thus, operating the motor 142 is effective to translate the carriage 126 and cross cutting blade 123 in the transverse direction 130 to cut the quilted material web 20.

A clamp bar 144 extends transversely over substantially a full width of the panel cutter 100 and is supported at its ends by cylinders 146. Motion of the clamp bar 144 in the vertical direction is guided by wheels 147 riding on opposite sides of linear guides 148. The actuators 146 move the clamp bar 144 toward a plate 149 to secure the quilted material web therebetween.

The trimming apparatus 122 includes left and right slitter and feed mechanisms 150, 152, respectively, that are located on opposite sides of the panel cutter 100 adjacent the ends of the pinch rollers 114. The slitter and feed mechanisms 150, 152 are described in detail in U.S. Pat. No. 6,736,078, the entirety of which is hereby incorporated by reference herein. Each of the slitter and feed mechanisms 150, 152 is operated by a motor 154 that rotates upper and lower slitting wheels 156,158, respectively, as well as upper and lower conveyors 160,162, respectively. Each of the slitter and feed mechanisms 152,154 has a carriage 164 that supports the motor 154, slitting wheels 156,158 and conveyors 160, 162 and is mounted via wheels 166 onto a guide rail 168. Each of the carriages 164 is mounted on a nut (not shown) that is threaded onto a screw 170 rotated by an actuator 172. Thus, the slitter and feed mechanisms 150, 152 are movable to desired positions on the rail 168 by operating respective actuators 172.

An upstream, center mark detector 180 has a sensor 182 mounted on a carriage 184 that is supported by linear guide rods 186 beneath the upstream table 112. The center mark detector 180 can be any device that is able to provide output signals representing a detected position of the center mark 48 on the quilted material web 20, for example, a vision camera. The vision camera has a charge coupled device (CCD) providing an output that is converted to digital form and processed to determine the location a center mark on the quilted material web 20. The carriage 184 is also connected to a drive belt 188 extending around an idler pulley 190 and a drive pulley 192 that is rotated by a motor 194. Thus, operation of the motor 194 is effective to move the sensor 182 in the longitudinal direction 118.

A downstream portion 106 has a downstream conveyor 174 operated by a drive pulley 176 that is rotated by a motor 178. A downstream length detector 196 has a sensor 198 mounted to a carriage 200 that is supported by linear guide rods 201. The sensor 198 can be any device capable of providing an output signal in response to detecting an edge of the quilted material web 20, for example, a photoeye. The carriage 200 is connected to a drive belt 202 looped over an idler pulley 204 and a drive pulley 206. A motor 208 rotates the drive pulley 206 to provide linear motion of the detector 198 in the longitudinal direction 118.

Figure 4:
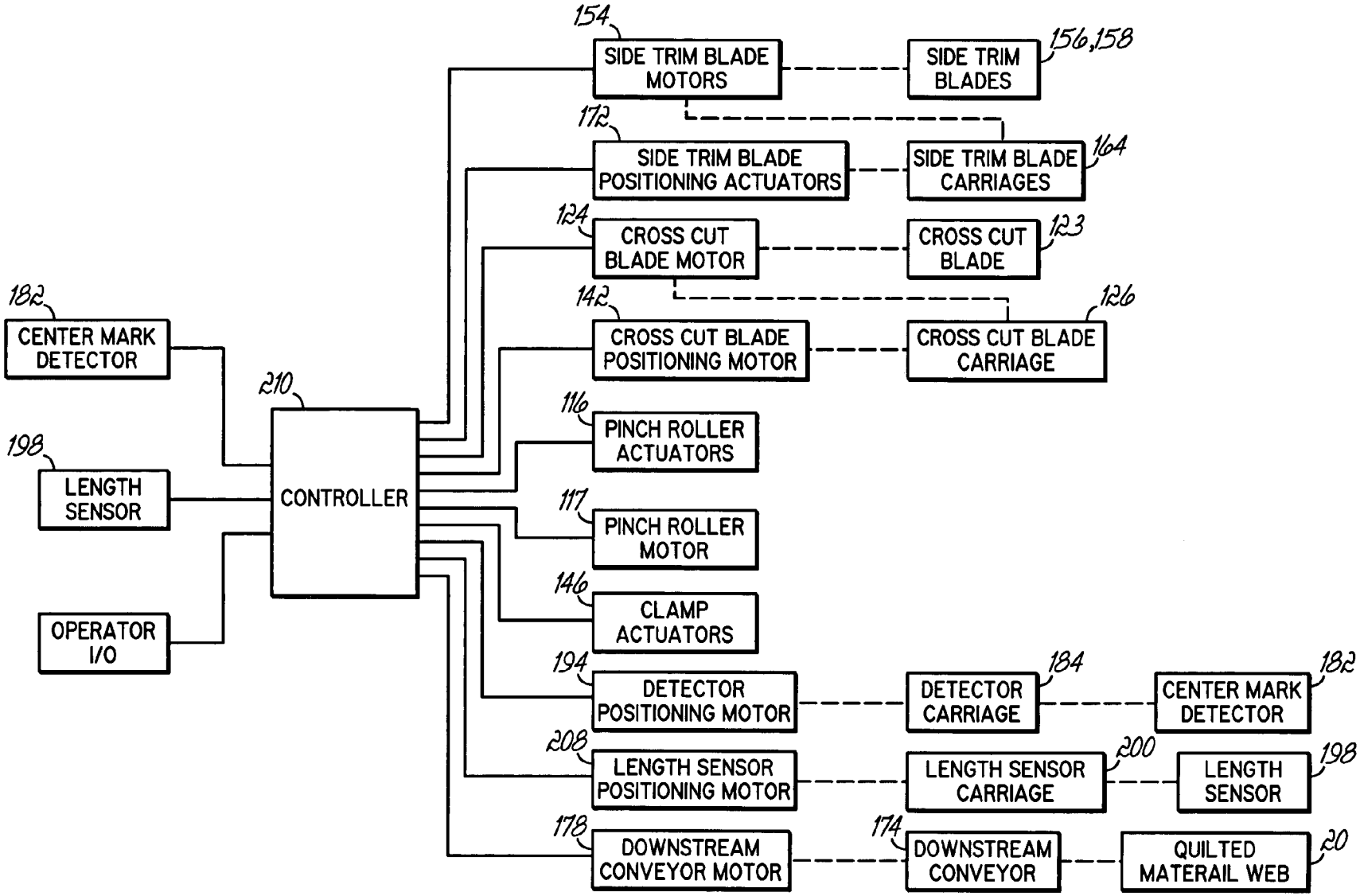
FIG. 4 is a schematic block diagram of a control system that may be used with the panel machine of FIG. 2 in accordance with the principles of the present invention.
Figure 5:
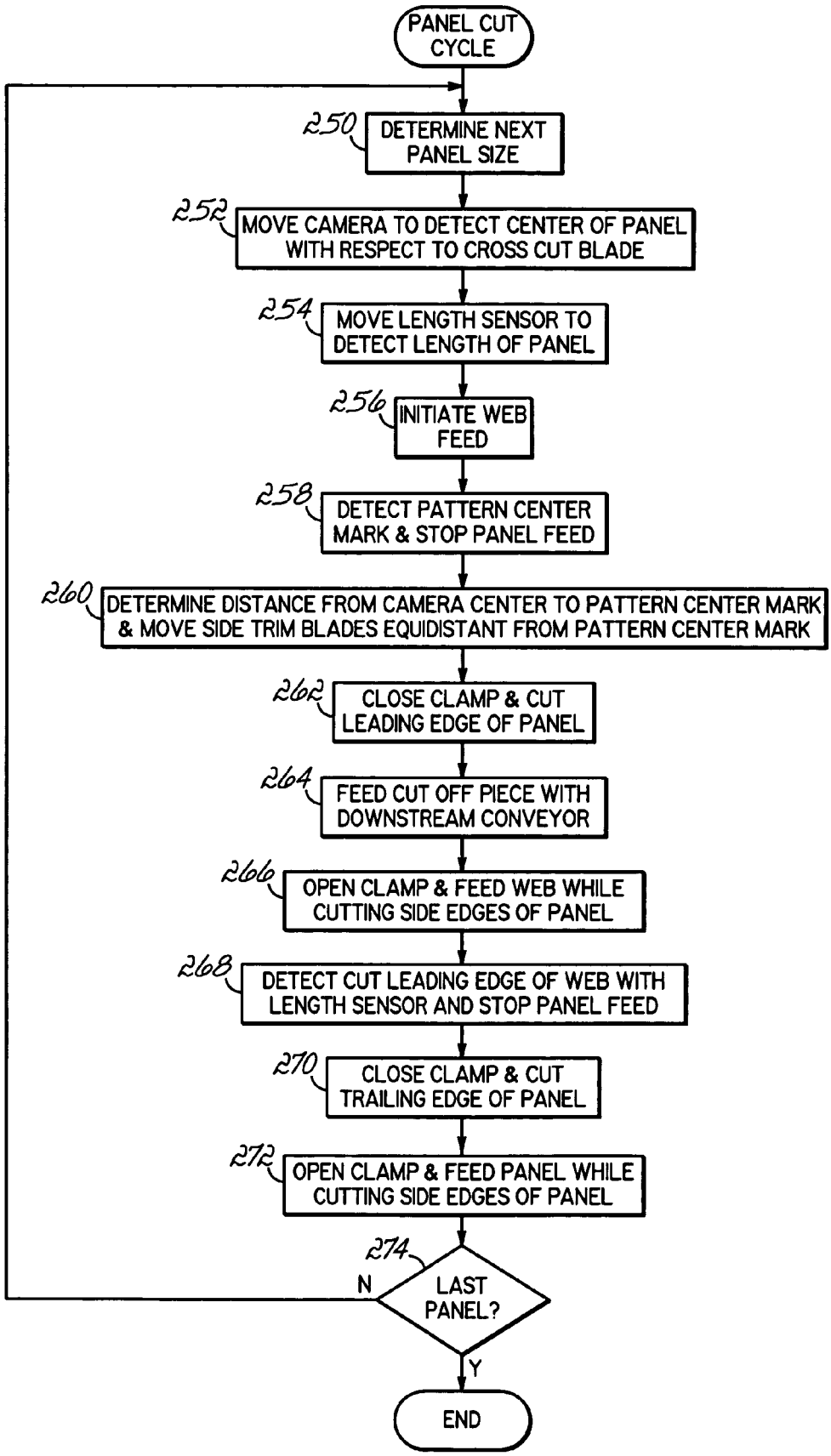
FIG. 5 is as flowchart indicating the process of cutting a panel from the quilted material web using the panel cutting machine of FIGS. 2 and 3.

As shown in FIG. 4, a programmable controller 210 is used to coordinate the operation of the various actuators and motors on the panel cutter 100 to execute a panel cutting operation as shown in FIG. 5. A quilted material web 20 is first loaded onto the panel cutter 100 and located between the pinch rollers 114, and the operator is then able to initiate a panel cutting cycle of operation. The controller 210 first determines, at 250, the size of the next panel 24 (FIG. 1). In this embodiment, the panel cutter 100 has the capability of cutting larger panels, for example, up to 80 inches wide and 60 inches long. However, substantially smaller panels may also be cut; and further, successive panels on the quilted panel web 20 may be of different sizes.

Assuming the first panel to be cut is 60 inches long and 80 inches wide, the controller 210 first commands the detector positioning motor 194, at 252, to move the detector carriage 184 and center mark sensor 182 to a location that is 30 inches upstream of the cross cut blade 123. Thus, as the web is moved downstream, the center mark sensor 182 is now in a position (transverse center line 66) for the sensor 182 to locate the next center mark on the quilted material web 20 with respect to the cross cut blade 123 (FIG. 2). In addition, the controller 210 commands the length sensor positioning motor 209 to move the length sensor carriage 200 and length sensor 198 to a position that is 60 inches downstream of the cross cut blade 123. In this position, the length sensor 198 is able to control the length of the panel to be cut from the quilted material web 20.

Thereafter, the controller 210, at 256, initiates a feed of the quilted material web 104. The web feed is initiated by the controller 210 commanding the pinch roller motor 117 (FIG. 3) to rotate the pinch rollers 114 in directions causing the web 20 to move downstream. The quilted material web 20 has a quilted pattern 32 on a top side facing upward above the upstream table 112 and a center mark 48 on an opposite, bottom side facing downward beneath the upstream table 112. Being below the upstream table 112, the center mark sensor 182 is viewing the bottom side of the web 20. When the center mark crosses a transverse centerline 66 (FIG. 1) in a field of vision of the sensor 182, the sensor 182 provides an output signal to the controller 210; and the controller commands the pinch roller motor 117 to stop. As will be appreciated, the process of stopping the operation of the pinch rollers 114 may involve successive decelerations of the pinch roller motor 117, such that the quilted material web 20 can be stopped with the center mark 48 precisely located on the centerline 66 of the field of vision of the sensor 182. If the center mark 48 is offset from a longitudinal centerline 68 (FIG. 1) of the field of vision of the sensor 182, as indicated by the center mark 48*a* shown in phantom in FIG. 1, sensor 182 and controller 210 are able, at 260, to determine the magnitude of the offset. The controller 210 then commands the side trim positioning motors 172 to position the slitter and feed mechanisms 150, 152, so that the side trim blades 156, 158 are equidistant from the detected center mark 48*a*.

Thereafter, at 262, the controller 210 commands the clamp actuators 146 to lower the clamp bar 144, thereby clamping the quilted material web 20 between the clamp bar 144 and stationary plate 149. Next, the controller 210 provides command signals to the cross cut blade motor 124 to initiate rotation of the cross cut blade 123. In addition, the controller 210 commands the cross cut blade positioning motor 142 to move the carriage 126 supporting the rotating cross cut blade 123 transversely across the panel cutter 100 along cut line 36 (FIG. 1). That motion is effective to cut off a crop-out piece 56 to form a leading edge of the panel 24. Upon the cross cut blade 123 finishing its transverse motion, the controller 210 terminates operation of the cross cut blade positioning motor 142 and initiates, at 264, operation of the downstream conveyor motor 178. Thus, the crop-out piece that has been cut off of the end of the quilted material web 20 is fed from the panel cutter 100.

The controller 210 then, at 266, commands the clamp actuators 146 to lift the clamp bar 144 from the plate 149, thereby unclamping the quilted material web. The controller 210 then turns On the side trim motors 154 of the left and right slitter and feed mechanisms 150, 152. Operating the side trim motors 154 initiates rotation of the upper and lower slitting wheels 156, 158, respectively, and the upper and lower conveyors 160, 162 of the slitter and feed mechanisms 150, 152. Thus, as the quilted material web 20 is pushed downstream by the pinch rollers 114, it is captured between the upper and lower conveyors 160, 162 (FIG. 3) on both sides of the panel cutter 100. The two sets of upper and lower conveyors 160, 162 are operative to pull the quilted material web 20 past respective sets of upper and lower slitting wheels 156, 158. The controller 210 also commands the operation of the down feed conveyor motor 178 to allow the down feed conveyor 174 to facilitate the conveyance of the quilted material web 20 along the panel cutter 100. Thus, the left and right sets of slitting wheels 156, 158 move along respective cut lines 40, 42 to form side edges of the panel 24 that are equidistant from the detected center mark.

That operation continues until, at 268, the length sensor 198 detects the leading edge 36 (FIG. 1) of the panel 24 and simultaneously provides a leading edge feedback signal to the controller 210. The controller 210 immediately turns Off the pinch roller feed motor 117, the two slitter and feed mechanism motors 154 and the downstream conveyor motor 178. Thereafter, the controller 210 commands the clamp actuators 146 to lower the clamp bar 144 onto the quilted material web 20 and against the fixed plate 149. In addition, the controller 210 commands the cross cut positioning motor 142 to move the carriage 126 and rotating cross cut blade 123 transversely across the panel cuter 100 along cut line 38 to form a trailing edge of the panel 24. Then, at 272, the controller 210 commands the clamp actuators 146 to raise the clamp bar and unclamp the quilted material web 20. The controller 210 then initiates a panel feed by activating the slitter and feed mechanism motors 154 and the downstream conveyor motor 178. The two sets of upper and lower slitter wheels continue to trim the side edges 40, 42 of the panel 32 to be equidistant from the center mark 48.

Thus, the panel cutter 100 has the advantage of cutting panels from a quilted material web in which quilted patterns are consistently and accurately centered on the panel. Further, with the panel cutter 100, successive quilted patterns can be of different sizes, and the panels can be accurately and quickly cut to different lengths and widths with the quilted panels centered thereon.

Figure 6:
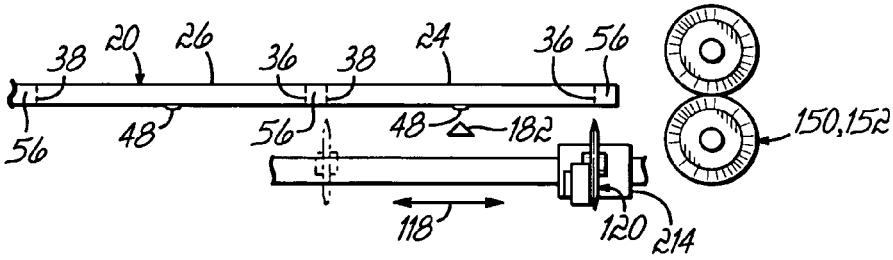
FIG. 6 is a schematic side view of the web of the quilted material of FIG. 1 illustrating a first cutting operation of another embodiment of a panel cutter in accordance with the principles of the present invention.
Figure 7:
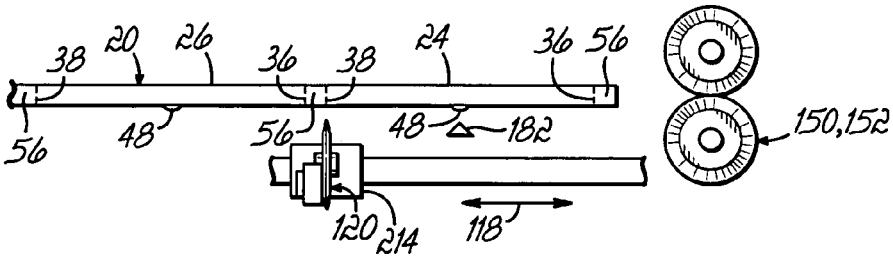
FIG. 7 is a schematic side view of the web of the quilted material of FIG. 1 illustrating a second cutting operation using components of the embodiment of FIG. 6.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. As will be appreciated, there are many variations relating to the structure and operation of the sensors 182, 198, the cross cutting apparatus 120 and the trimming apparatus 150, 152. For, example, FIG. 6 illustrates an alternative embodiment of the panel cutter 100 that uses a cross cutting apparatus 120 and a single center mark sensor or camera 182. The cross cutting apparatus 120 is mounted on a second cross cut blade carriage 214 that provides motion of the cross cutting apparatus 120 in the longitudinal direction 118. Thus, the cross cutting blade 123 is movable to the left and right as viewed in FIG. 6. In a process similar to that previously described, the controller 210 is operative to move the quilted material web 20 to the right as viewed in FIG. 6 and to cause the cross cutting apparatus 120 to cut the web 20 along the cut line 36. Thereafter, the controller 210 provides command signals to move the cross cutting apparatus 120 to the left as viewed in FIG. 6 to the position shown in FIG. 7. The cross cutting apparatus 120 is moved through a distance equal to a length of the quilted panel 24, that is, the distance between the cross cut paths 36, 38. As described earlier, the controller 210 is operative to cause the cross cutting apparatus 120 to move across the quilted material web 20 along the cut line 38, thereby cutting the panel 24 to the desired length. Thereafter, the controller 210 initiates motion of the quilted web material 20 and causes the slitter and feed apparatus 150, 152 to cut along the trim lines 40, 42 to form the side edges of the panel.

Figure 8:
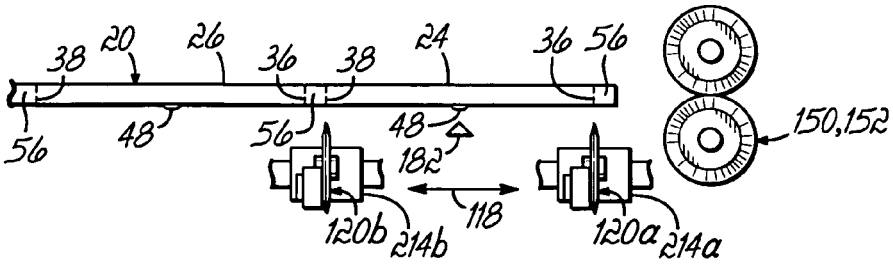
FIG. 8 is a schematic side view of the web of the quilted material of FIG. 1 illustrating a further embodiment of a panel cutter in accordance with the principles of the present invention.

FIG. 8 illustrates a further embodiment of the panel cutter 100 using a single center mark sensor 182 and two cross cutting apparatus 120*a*, 120*b*. Each of the cross cutting apparatus 120*a*, 120*b* is supported on a separate cross cut carriage 214*a*, 214*b* that is movable in the longitudinal direction 118. In a manner as earlier described, the controller 210 is operative to feed the quilted web 20 to the right as viewed in FIG. 8 until the center mark 48 is detected crossing the centerline 66 (FIG. 1) of the sensor 182. The controller 210 then stops the feed of the quilted material web 20. Thereafter, the controller 210 causes the cross cutting apparatus 120*a*, 120*b* to be moved in a longitudinal direction, so that the center mark 48 is centered between them. The controller 210 then causes the cross cutting apparatus 120*a*, 120*b* to move along the cut lines 36, 38, thereby cutting the panel 24 to its desired length. As will be appreciated, alternatively, the controller 210 can operate the cross cutting apparatus 120*a*, 120*b* sequentially or simultaneously. As will be appreciated, in a still further embodiment, both of the two cross cut blades and motors can be mounted on the respective longitudinal carriages 214*a*, 214*b* instead of the transverse carriage of FIG. 2. Then the longitudinal carriages 214*a*, 214*b* can be mounted on separate or a common transverse carriage.

Figure 3:
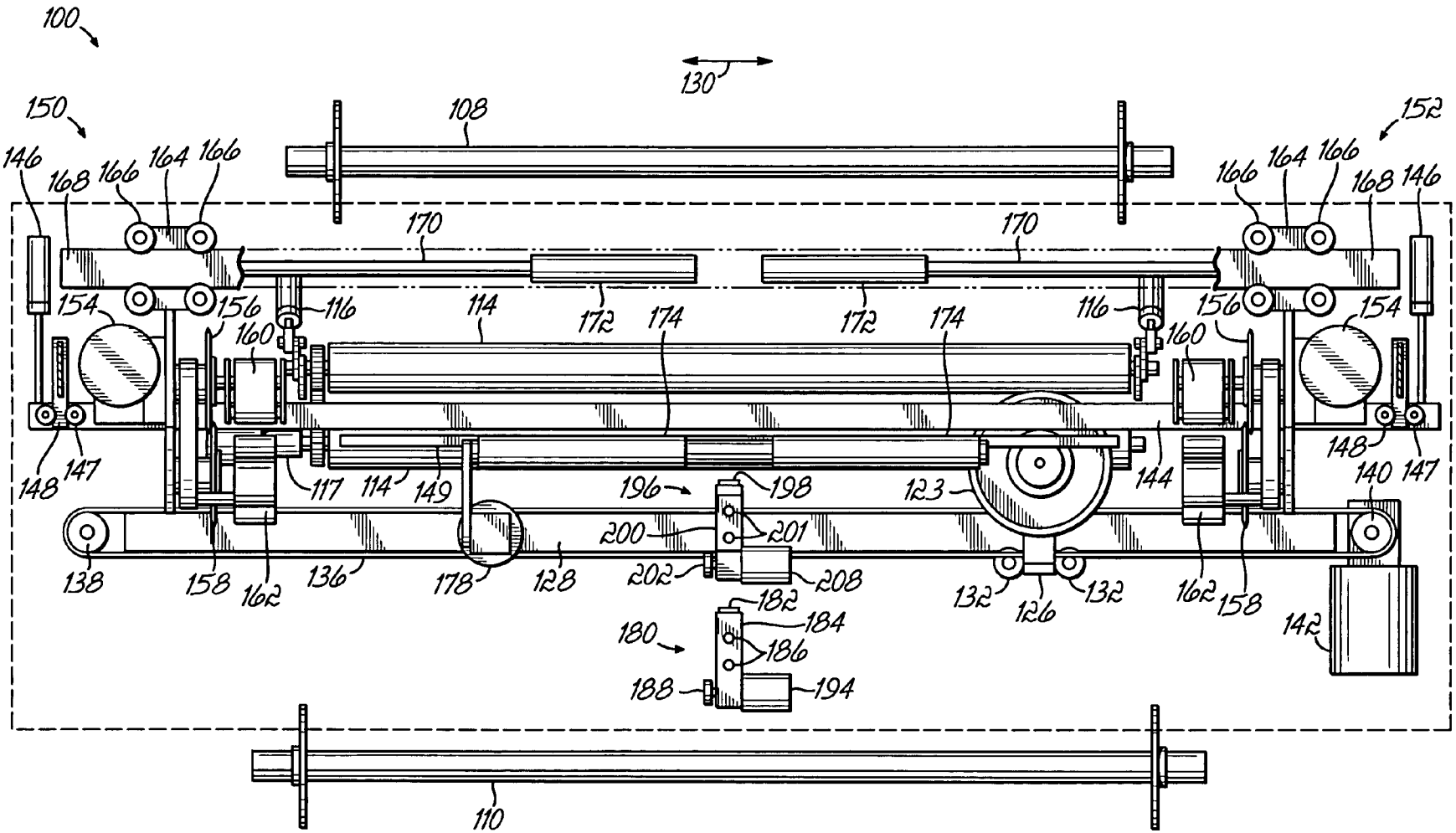
FIG. 3 is a schematic end view of the panel cutting machine of FIG. 2 looking upstream from the downstream end of the panel cutting machine.
Figure 9:
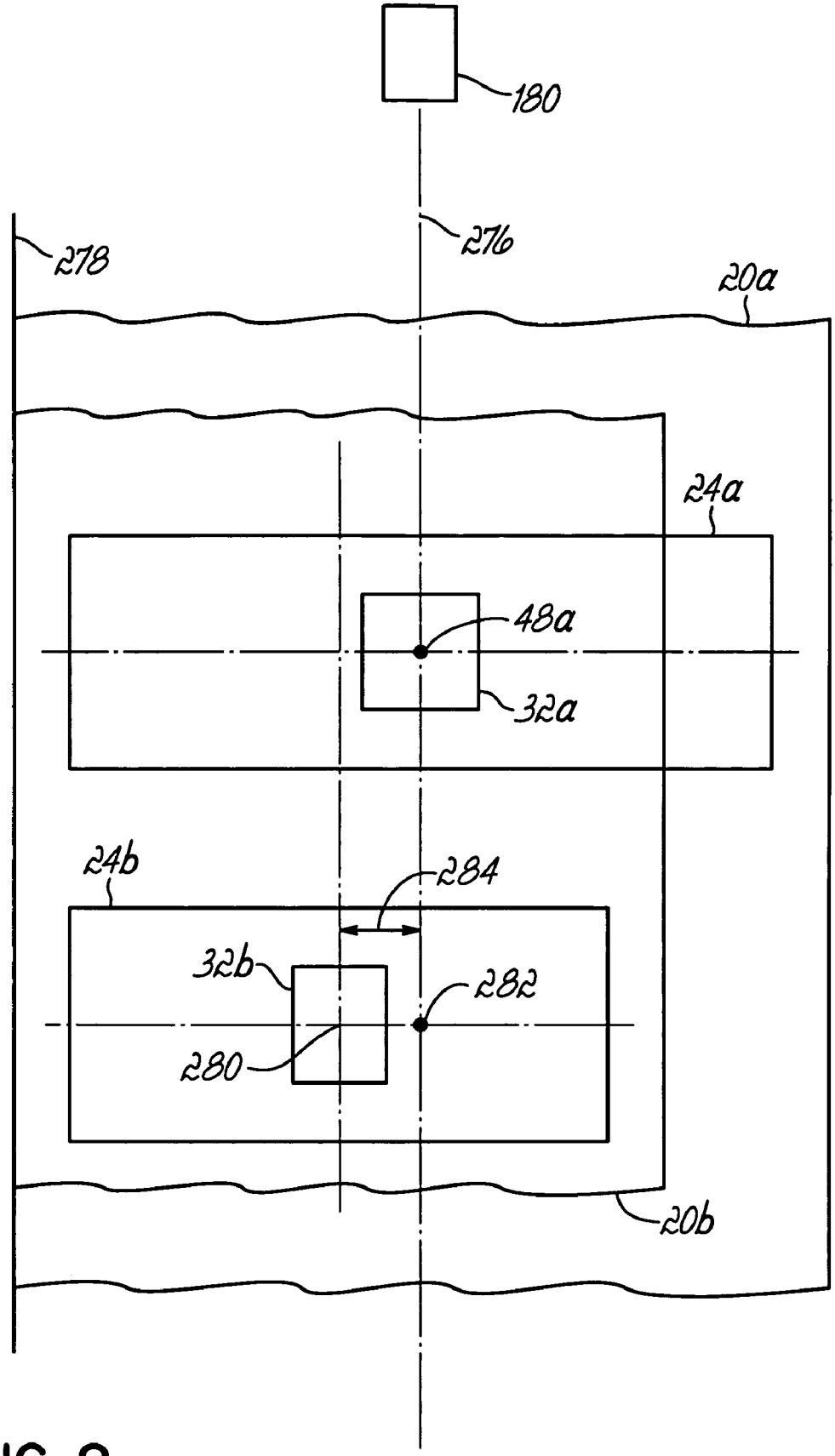
FIG. 9 is a schematic illustration of a further embodiment of a panel cutter that accommodates webs of quilted material having different widths in accordance with the principles of the present invention.

As indicated earlier, the panel cutter 100 can be designed to cut relatively large panels, for example, up to 80 inches wide; and further, it is desirable that the panel cutter 100 and its associated control be usable to cut quilted pattern webs of different widths without making changes to the machine structure. One such process is schematically shown in FIG. 9, in which a panel cutter, as shown and described with respect to FIGS. 2-4, is designed for a first, wider web 20*a* having a first quilted pattern 32*a*. A center mark detector 180 as previously described is generally aligned with a longitudinal centerline 276 of the panel cutter. In that location, the center mark detector 180 can easily detect the center mark 48*a*; and in a manner shown and described with respect to FIGS. 2-4, a control operates a cross cutting apparatus and a trimming apparatus to cut a panel 24*a* from the wider web 20*a*, so that the quilted pattern 32*a* is centered within the panel 24*a*.

Referring to FIG. 9, often, it is desirable to use the same panel cutter to cut a second quilted web 20*b* that is narrower than the quilted web 20*a*; and often the narrower quilted web 20*b* has a quilted pattern 32*b* that is narrower than the quilted pattern 32*a*. In order to cut the narrower quilted web 20*b* on a panel cutter constructed to cut the wider quilted web 20*a*, the narrower quilted web must be aligned with the panel cutter. In this exemplary embodiment, the left edges of the respective quilted webs 20*a*, 20*b* are aligned with a reference line 278 associated with the panel cutter. The reference line 278 can be provided by an edge of a panel cutter component, a mechanical guide or fence, one or more edge detectors or sensors, a laser beam, etc.

As shown in FIG. 9, if the narrower quilted web 20*b* is aligned with the edge guide 278, a geometric center point 280 of the narrower quilted pattern 32*b* is outside a field of detection of the center mark detector 180. Consequently, a center mark located at the center point 280 of the narrower quilted pattern 32*b* would not be detectable by the center mark detector 180. In order to detect the narrower quilted pattern 32*b*, a pseudo center mark 282 is applied to the narrower web 20*b*. In its simplest form, the pseudo center mark 282 is displaced or offset from the geometric center point 280 by a dimensional quantity that is, at least, a magnitude required to place the pseudo center mark 282 within the field of detection of the center mark detector 180. More often, the magnitude of the offset 284 of the pseudo center mark 282 places it in general alignment with the machine centerline 276. Thus, the pseudo center mark 282 has a common longitudinal location with the geometric center point 280 but is offset in a direction substantially perpendicular to the machine centerline 276.

As noted earlier, the center mark 48*a* and pseudo center mark 282 can be automatically applied to the web 20 as part of the quilting process using a variety of mediums and processes. Further, a width of a quilted web entering a quilting machine is known or can be easily detected. In most applications, a quilting machine and/or panel cutter are set up for a particular width web, and that setup is maintained for a substantial production run. Therefore, knowing a web width and location of a quilted pattern, a control associated with a quilting machine can be easily programmed to apply the pseudo center mark 282 with the desired offset 284. Similarly, the offset 284 of the pseudo center mark 282 used by a quilting machine can also be programmed in a control of a panel cutter. If the panel cutter is operating as part of a continuous processing line downstream of the quilting machine, offsets for quilted patterns and quilted panel widths can be electronically transferred from the quilting machine control to the panel cutter control in a known manner. If the panel cutter is operating independently of the quilting machine, the offsets for respective quilted patterns and quilted web widths can be manually programmed each time the panel cutter is set up to run a quilted panel web. Alternatively, the offsets for respective quilted patterns and quilted web widths can be determined from information stored in the panel cutter control.

The determination of the exact location of center marks, for example, center mark 48*a* and pseudo center mark 282, may vary. Further, the quilting machine control can apply the center marks before or after a pattern is quilted in the web. In most applications, the center marks are applied prior to a pattern quilting operation at a location representing an expected geometric center of the quilted pattern exclusive of "shrinkage", which will subsequently be explained.

It should be noted that quilted webs vary significantly in thickness and may be, for example, up to several inches in thickness. Further, it is known that the process of quilting a pattern results in a "shrinkage" of the quilted pattern from a theoretical size. Further, the magnitude of shrinkage is principally dependent upon a few process parameters, for example, the thickness of the quilted pattern, the composition of the materials comprising the web and the quilted pattern and the order in which different portions of the pattern are quilted. Further, for given values of those process parameters, shrinkage of the quilted pattern is often repeatable and thus, predictable. Therefore, applications in which shrinkage increases the probability that a center mark located at an expected geometric center prior to quilting the pattern will not correspond to a center of the quilted pattern can be identified Further, in those applications, as well as any application, the quilting machine control can be programmed to execute a pattern quilting process that minimizes shrinkage, thereby maintaining the integrity of a center mark applied at an expected pattern center point prior to quilting the pattern.

Alternatively to a center mark being applied before a pattern being quilted, the center mark can be applied either, during a pattern quilting process or, after the pattern is quilted in the web. In one application, this can be done automatically by a camera or other video detector that senses edges of the quilted patterns, so that respective center points can be automatically determined by a machine control that then commands an application of respective center marks. In other applications, the quilted patterns in a web can be visually inspected by a human being, and respective center marks manually applied. More specifically, a web of quilted patterns can be unrolled or spread out on a flat surface with the finished side of the quilted patterns facing down. By a simple visual inspection of a rear side of the quilted pattern or, by using one or more measuring instruments, a human being can determine geometric centers of respective quilted patterns and then, manually apply respective center marks. Thereafter, the quilted pattern web can be fed into a panel cutter as described herein; and quilted panels cut, so that the quilted pattern is generally centered within the cut quilted panel.

The use of a pseudo center point 282 is only one example of using a common panel cutter machine to cut quilted panels from webs of different widths. In another embodiment, the center mark detector 180 of FIGS. 2 and 3 can be mounted on a carriage that is movable under program control in a direction substantially perpendicular to the panel cutter centerline. Thus, with each quilted pattern, the center mark detector 180 can be moved laterally so that a center mark at a geometric center of the pattern is located within the field of detection of the center mark detector 180. In a further embodiment, if an expected range of quilted pattern center locations for different web widths is sufficiently narrow, the center mark detector 180 can be mounted about at the middle of that range, so that the expected locations of the center marks are within its field of detection.

In view of the above descriptions, center mark, as used herein, means indicia, which is automatically or manually applied to a web of material and indicates, represents or has a known dimensional relationship to, a center of a pattern that will be, is being, or has been quilted in the web of material.

Therefore, the invention in its broadest aspects is not limited to the specific details shown and described. Consequently, departures may be made from the details described herein without departing from the spirit and scope of the claims that follow.

What is claimed is:

1. A method of cutting a quilted material web having quilted patterns into panels, each of the panels having a width and a length with a respective quilted pattern disposed therein, the method comprising:

applying center marks to the quilted material web, the center marks identifying centers of respective quilted patterns;

providing a cross cutting apparatus for cutting end edges of respective panels;

providing an edge detector for detecting end edges of respective panels;

providing a trimming apparatus for cutting side edges of the panels;

providing a center detector for locating the centers of the quilted patterns by detecting the center marks;

moving the center detector to a position longitudinally displaced from the cross cutting apparatus by a distance substantially equal to one-half the length of a panel;

moving the quilted material web in the longitudinal direction;

detecting a position of a center mark;

stopping motion of the quilted material web in response to detecting the position of the center mark;

transversely centering the trimming apparatus relative to the center of the panels in response to the detecting of the position of the center mark;

operating the cross cutting apparatus to form a first end edge of the panel;

moving the edge detector to a position longitudinally displaced from the cross cutting apparatus by a distance substantially equal to the length of the panel;

moving the quilted material web in the longitudinal direction;

operating the trimming apparatus to simultaneously longitudinally cut opposed side edges of the panel substantially equidistant from the center of the panel;

detecting the first end edge with the edge detector;

stopping motion of the quilted material web in response to detecting the first end edge; and operating the cross cutting apparatus to form a second end edge of the panel, the first end edge and the second end edge being equidistant from the center of a panel.

2. The method of claim 1 wherein the quilted pattern is formed of chain-stitch sequences having a finish side on one side of the quilted material web, and the applying the center marks includes applying the marks to the side of the web that is opposite to the finish side of chain stitches forming the pattern.

3. The method of claim 2 wherein the applying of the marks includes printing the center marks on the side of the web opposite said finish side.

4. A method of cutting a quilted material web having quilted patterns into panels, each of the panels having a width and a length with a respective quilted pattern disposed therein, the method comprising:

applying center marks to the quilted material web, the center marks identifying centers of respective quilted patterns;

moving a center detector to a position longitudinally displaced from the cross cutting apparatus by a distance substantially equal to one-half the length of a panel;

moving the quilted material web in a longitudinal direction;

detecting a position of a center mark with the center detector;

stopping motion of the quilted material web in response to the detecting of the position of the center mark;

transversely centering a trimming apparatus relative to the center of the panels in response to the detecting of the position of the center mark;

operating a cross cutting apparatus to form a first end edge of the panel;

moving an edge detector to a position longitudinally displaced from the cross cutting apparatus by a distance substantially equal to the length of the panel;

moving the quilted material web in the longitudinal direction;

operating the trimming apparatus to simultaneously longitudinally cut opposed side edges of the panel substantially equidistant from the center of the panel;

detecting the first end edge with the edge detector;

stopping motion of the quilted material web in response to detecting the first end edge; and operating the cross cutting apparatus to form a second end edge of the panel, the first end edge and the second end edge being equidistant from the center of a panel.

5. The method of claim 4 wherein the quilted pattern is formed of chain-stitch sequences having a finish side on one side of the quilted material web, and the applying the center marks includes applying the marks to the side of the web that is opposite to the finish side of chain stitches forming the pattern.

6. The method of claim 4 wherein the applying of the marks includes printing the center marks on the side of the web opposite said finish side.

* * * * *

UNITED STATES PATENT AND TRADEMARK OFFICE

CERTIFICATE OF CORRECTION

PATENT NO. : 7,617,751 B2
APPLICATION NO. : 11/339602
DATED : November 17, 2009
INVENTOR(S) : Michael A. James et al.

It is certified that error appears in the above-identified patent and that said Letters Patent is hereby corrected as shown below:

Column 10

Line 29, "the cross cutting apparatus" should be --a cross cutting apparatus--.

Signed and Sealed this
Nineteenth Day of July, 2011

David J. Kappos

David J. Kappos
*Director of the United States Patent and Trademark Office*